252-102 AU 165 EX
5/11/76 OR 3,956,158

United States Patent [19]
Donaldson

[11] 3,956,158
[45] May 11, 1976

[54] POURABLE LIQUID COMPOSITIONS

[75] Inventor: Robert Donaldson, Wirral, England

[73] Assignee: Lever Brothers Company, New York, N.Y.

[22] Filed: Jan. 16, 1974

[21] Appl. No.: 433,949

[30] Foreign Application Priority Data
Jan. 7, 1974 United Kingdom ..... 675/74

[52] U.S. Cl. ..... 252/102; 252/120; 252/130; 252/131; 252/140; 252/155; 252/173; 252/DIG. 14

[51] Int. Cl.[2] ..... C11D 7/54

[58] Field of Search ..... 252/112, 113, 115, 116, 252/119, 128, 129, 130, 131, 154, 155, 163, 164, 165, DIG. 14, 89, 98, 95, 96, 102, 117, 118, 120, 140, 173, 547, 549, 550

[56] References Cited

UNITED STATES PATENTS

| | | | |
|---|---|---|---|
| 3,281,367 | 10/1966 | Jones et al. | 252/112 |
| 3,406,116 | 10/1968 | Vitale | 252/99 |
| 3,454,500 | 7/1969 | Lancashire | 252/110 |
| 3,520,818 | 7/1970 | Cambre | 252/113 |
| 3,522,186 | 7/1970 | Cambre | 252/112 |
| 3,536,628 | 10/1970 | Lancashire | 252/117 |

FOREIGN PATENTS OR APPLICATIONS

| | | | |
|---|---|---|---|
| 1,254,272 | 11/1967 | Germany | 252/113 |

*Primary Examiner*—Thomas J. Herbert, Jr.
*Assistant Examiner*—Bruce H. Hess

[57] ABSTRACT

A pourable liquid composition such as a detergent scourer comprises an aqueous medium containing a three-dimensional network of insoluble entangled filaments and particulate solid dispersed in the medium and prevented from separating by the filament network.

20 Claims, 6 Drawing Figures

POURABLE LIQUID COMPOSITIONS

Figure 1:
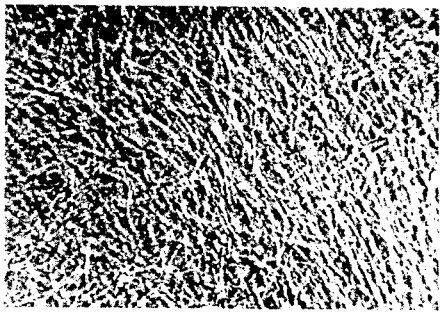

This invention relates to pourable liquid compositions containing dispersed particulate solids and to processes for preparing them.

The formulation of pourable liquid detergent compositions containing solid particles of abrasive material and suitable for cleaning hard surfaces presents difficulties because the particles, being generally of higher density than the liquid medium in which they are dispersed, tend to settle out on storage, and this is inconvenient to the consumer, who has to re-disperse them at the time of use. Proposals have been made to solve this problem by dissolving in the liquid medium substances which confer on it a substantial yield stress value, that is, the medium exhibits Bingham plastic characteristics, and requires a definite threshold stress to be applied before it will flow. Because the force which causes particle deposition, namely gravitational force acting on the particles relative to that acting on the medium, with a strength proportional to the difference in density between the medium and the particles, is less than the yield stress value, particles dispersed in the medium do not separate out. Such a composition only becomes pourable after a shear stress greater than the yield stress has been applied; in some instances this can only be achieved by shaking or stirring, but the composition may remain pourable for some time after the shear stress has been removed. It is preferable, however, that the composition should be pourable after storage without the application of shear stress other than that provided by gravity when a vessel containing the composition is tilted, and for this the yield stress value must be less than the force of gravity acting on the medium itself.

Suitable liquid media can be obtained by dissolving in water substances which exhibit micellar interaction, and compositions employing this principle are described in British Pat. Nos. 1,303,810 and 1,308,190.

The present invention provides a solution to the problem of preparing pourable liquid media with Bingham plastic characteristics using a new principle, namely the presence of a three-dimensional network of entangled filaments of insoluble material which confer yield stress values upon the medium containing them, and which prevent the separation of particulate solid dispersed in the medium.

A pourable liquid composition of the invention comprises an aqueous medium containing a three-dimensional network of insoluble entangled filaments and particulate solid dispersed in the medium and prevented from separating from the medium by the filament network. Preferably the composition is one that after storage is pourable without the application of shear forces other than gravity, as when a vessel containing the composition is tilted to allow outflow.

The composition has a yield stress value at 20°C preferably of from 1 to 21 dynes/cm$^2$, and especially of from 4 to 15 dynes/cm$^2$. By "yield stress value" is meant the stress value determined in the limit of zero shear rate approaching zero shear rate using the very low shear rates attained in the low shear viscometer described by van den Tempel and Lucassen-Reynders, J. Phys. Chem., 1963, 67, 731. The values thus obtained are the same as those found by a "static" method in which the minimum turning force required to move the inner cylinder of the same viscometer relative to the outer cylinder, with the test material present between the cylinders, is measured, and this force is converted into a yield stress value by calculation using the viscometer dimensions. These values are not those obtained by a method that is sometimes used in which the value is taken to be the intercept on the shear stress axis of a plot of shear stress against shear rate where the shear rates used are very much higher than those of the low shear viscometer; this method can give values that are highly inaccurate and misleading where the static conditions of dispersed particles are concerned.

Preferably the aqueous medium has a viscosity at 20°C of from 1 to 60 poise at a shear rate of 7 sec$^{-1}$. To be pourable the aqueous medium will require to be shear-thinning, that is, to exhibit non-Newtonian flow characteristics, viscosity diminishing with increasing shear rate, so that flow of the composition is facilitated during pouring when the aqueous medium flows in response to gravitational force. For instance the viscosity (the ratio of shear stress to shear rate) at a shear rate of 380 sec$^{-1}$ will be less than that at a rate of 21 sec$^{-1}$. Preferably the aqueous medium has viscosities at 20°C of from 1 to 30, and especially 5 to 20, poise at a shear rate of 21 sec$^{-1}$; and from 0.1 to 3.0 poise at a shear rate of 380 sec$^{-1}$, the ratio of viscosities at these shear rates being from 4 to 18:1, particularly from 8 to 18:1, and especially from 10 to 17:1.

The filaments of the network, which are, of course, solid material, preferably have a length to diameter ratio of at least 60, and this ratio can be as high as 10,000, but only a minimum ratio is of significance in providing an entangled network. Filament diameter is preferably within the range of from 0.1 to 100 $\mu$, wide variation within this range being possible, depending on the material of which the filament is composed. By "insoluble" it is meant that the filament is insoluble in the aqueous medium at the temperature of that medium. Entanglement of a network is provided by branching or abrupt curvature of filament, which can be seen by looking at the network under suitable magnification, or by frictional interference due to filament surface discontinuity. The network can, for instance, be examined by placing a drop of liquid medium between two glass slides and viewing under phase contrast conditions at a magnification of × 40. Whether the necessary entangled filaments are present in any particular aqueous medium or composition is readily determined by finding whether it has a yield stress value greater than that of the aqueous medium from which the filaments and particulate material have been removed, for instance by centrifugation. The amount of filament present is preferably within the range of from $(d_f - 3/4)$ to $(5\,d_f - 1/2)$ by weight, where $d_f$ is the density of the filamentary material. The yield value of the composition is directly related to the amount of filamentary material used, as the particulate material does not contribute appreciably to the yield stress value.

The filamentary material can be one which is preformed and introduced into the remainder of the aqueous medium, or it can be formed during the prepartion of the aqueous medium. The filamentary material can be any substance having the physical characteristics described above. Examples of typical materials are asbestos and cellulose, such as long-fibre asbestos and the cellulose fibres of newsprint, such materials being suitably dispersed in the remainder of the aqueous medium. Preferably the material of the filaments is soluble in the aqueous medium at its boiling point, but capable of forming the network of entangled filaments on cooling a solution of the filamentary material in the remainder of the aqueous medium at elevated temperature. Examples of suitable filamentary materials of this kind are soaps. The sodium salts of saturated $C_{14}$ to $C_{22}$ fatty acids are preferably employed. Typical examples are the sodium salts of myristic, palmitic, stearic and behenic acids. Suitable amounts of soap are from 0.5 to 2.5% by weight of the aqueous medium.

The remainder of the aqueous medium is chosen so that, together with the filamentary material, it provides the properties described above. Aqueous media containing detergent-active compounds are of especial value, for liquid scouring compositions can be prepared using them. Where a soap is used as filamentary material, this being s detergent-active compound, it provides a contribution to detergent properties when the composition is diluted with water at the time of use. Preferably, however, the aqueous medium contains a non-soap detergent-active compound in solution, especially an anionic detergent-active compound. Particularly valuable are alkali metal, especially sodium, $C_{12}$ to $C_{18}$ alkyl sulphates, especially those with a straight chain alkyl group. Examples of suitable compounds are sodium lauryl, palmityl and stearyl sulphates.

In order to provide the viscosity characteristics of the aqueous medium it is preferable to employ a combination of detergent-active compounds that exhibit micellar interaction, as manifested by a viscosity significantly higher than the mean of those exhibited by the constituent compounds, which is best seen at low shear rates. It has been found that particularly suitable are combinations of alkali metal $C_{12}$ to $C_{18}$ alkyl sulphates with trialkylamine oxide, trialkyl phosphine oxide or dialkyl sulphoxide detergent-active compounds. Such compounds are well known in the detergent art, and suitable compounds are amine oxides $R_3NO$ where one group R is a $C_{10}$ to $C_{18}$ *n*-alkyl group and the other groups R are each methyl or ethyl; phosphine oxides $R_3PO$ where one group R is a $C_{10}$ to $C_{18}$ *n*-alkyl group and the other groups R are each methyl or ethyl; and sulphoxides $R_2SO$, where one group R is a $C_{10}$ to $C_{18}$ *n*-alkyl group and the other is methyl or ethyl. Examples of detergent-active compounds of this type are dimethyllaurylamine oxide, dimethylmyristylamine oxide, dimethylpalmitylamine oxide, dimethylstearylamine oxide, dimethyllaurylphosphine oxide and methyllaurylsulphoxide. In order to obtain an effective micellar interaction it is preferable to employ with the alkali metal $C_{12}$ to $C_{18}$ alkyl sulphate a trialkylamine oxide, trialkylphosphine oxide or dialkyl sulphoxide detergent-active compound and an electrolyte with a univalent or divalent cation, in such amounts that the aqueous medium has a viscosity at 20°C of from 1 to 60 poise at a shear rate of 7 $sec^{-1}$.

By "electrolyte with a univalent or divalent cation" is meant a substance that dissolves in water to provide univalent or divalent cations, but excluding surface-active organic compounds. Normally the electrolyte will be an inorganic compound, for instance a salt. Suitable inorganic electrolytes are those providing sodium, potassium, ammonium, calcium and magnesium ions, for example sodium hydroxide, sodium chloride, sodium bromide, sodium hypochlorite, sodium chlorate, sodium carbonate, sodium sulphate, trisodium orthophosphate, sodium tripolyphosphate, and calcium chloride. Sodium acetate is an example of an organic salt that can be used as electrolyte.

The amount of alkali metal $C_{12}$ to $C_{18}$ alkyl sulphate suitable will in general be within the range of from 0.5 to 5% by weight of the aqueous medium; the amount of oxide detergent-active compound will generally be within the range of from 0.1 to 2% by weight of the aqueous medium; and the weight ratio of alkali metal $C_{12}$ to $C_{18}$ alkyl sulphate to the oxide detergent-active compound will generally be within the range of from 0.3:1 to 15:1, and most often within the range of 0.7:1 to 5:1. The amount of electrolyte suitable will depend on whether it has a univalent or divalent cation, for the contribution of a divalent cation to the micellar interaction is about 20 times that of a univalent cation. Where a univalent cation electrolyte is employed, the amount suitable is generally within the range of 0.05 to 0.75 moles per liter of aqueous medium.

The viscosity of the aqueous medium can be strongly affected by the presence of small quantities of organic compounds of low molecular weight which may be added for other purposes, for instance as perfumes, or which may be present as impurities in commercial materials, for instance as a longchain alcohol present in a sodium alkyl sulphate derived from it, and the amounts of ingredients employed should take this into account. Moreover the simultaneous use of incompatible ingredients is, of course, to be avoided: for instance ammonium salts cannot be used in the presence of sodium hypochlorite.

It is necessary to take account of the fact that some of the oxide detergent-active compounds are protonated at low pH and lose the property of giving micellar interaction with the alkyl sulphate detergent-active compounds when they are in a protonated condition. The pH of the aqueous medium should therefore be sufficiently high to avoid protonation: for instance the pH of the aqueous medium should be greater than 8.5 when an amine oxide is employed.

An alkali metal hypochlorite is preferably present in the aqueous medium, for this enables bleaching compositions to be prepared. Many detergent compounds are incompatible with hypochlorite, but the above-described aqueous media containing alkyl sulphate and oxide detergent-active compounds are compatible with hypochlorite, and compositions containing them and hypochlorite are of especial value as bleaching detergent compositions. When hypochlorite is required for its bleaching properties the aqueous medium can contain from 0.02 to 4 or 5%, and preferably from 0.1 to 2% by weight of the hypochlorite compound. Where hypochlorite is present the pH of the aqueous medium should be above 9.8 if its decomposition is to be minimised. Since the hypochlorite is a univalent cation electrolyte, it is necessary to adjust the total amount of such electrolyte accordingly.

The following procedure is a simple test enabling the choice of suitable amounts of ingredients for an aqueous medium showing suitable properties as a result of micellar interaction between an alkali metal alkyl sulphate and an amine oxide, phosphine oxide or sulphoxide referred to above, and taking account of the effects of impurities and miscellaneous additional ingredients such as perfumes.

The sulphate and oxide detergent-activve compounds are mixed together in a series of ratios of from 0.3:1 to 16:1 of sulphate to oxide by weight, the mixture dissolved by heating in water at a concentration of 0.2 of total moles per liter of the two substances, together with any other components of the medium than the filamentary material and the electrolyte, and the pH of the hot solution adjusted to that which is to be adopted, using a small amount of acid or alkali as required.

The electrolyte chosen to induce micellar interaction is then added progressively to the solution at ambient temperature in steps of 0.05 moles per liter concentration for a univalent cation electrolyte, or 0.0025 moles per liter for a divalent one. If the mixture becomes inhomogeneous at any stage, it is heated and cooled. Addition is continued until permanent two phase formation occurs. The shear stress of the mixture is determined at 20°C at a shear rate of 7 $sec^{-1}$ after each electrolyte addition, using a concentric cylinder viscometer.

A plot is then made on a graph of shear stress against electrolyte concentration for each of the series of compositions, and from the set of curves obtained a suitable ratio of the ingredients is chosen. The proportions of ingredients for optimum micellar interaction correspond to the highest stress values.

In the above manner the ratio of the components of an aqueous medium other than the electrolyte and the filamentary material can readily be chosen, and the selected components are then employed at a total concentration suitable for the specific purpose required, while maintaining the same concentration of electrolyte as was found by the test, and with the chosen filament network imposed upon them as described below.

Other aqueous media employing a combination of detergent-active compounds that exhibit micellar interaction and that can be used in compositions of the invention are ones where the filamentary network is provided by preformed filamentary material and the remaining ingredients are aqueous solutions of mixtures of detergent-active compounds exhibiting micellar interaction and also a yield stress value. In such instances the contributions of the solutions and the network to the yield stress value of the compositions are cumulative. Suitable aqueous detergent solutions are the nonionic detergent suspending liquids described in British Pat. No. 1,262,280; the suspending liquids containing anionic detergents and amphiphilic compounds described in British Pat. No. 1,308,190; the liquid detergent compositions containing ammonium soaps and zwitterionic compounds described in British Pat. No. 1,167,597; and the liquid detergent compositions containing alkylbenzene sulphonates and zwitterionic compounds and used as aqueous media for suspending particulate solids which are described in British Pat. No. 1,181,607 and U.S. Pat. Nos. 3,579,456 and 3,623,990. The aqueous medium can also be a thixotropic composition with a filamentary network superimposed.

Where the filamentary network is provided by preformed filamentary material, the latter is dispersed in the whole or part of the water content of the aqueous medium and the remaining ingredients added, if necessary dissolving them by heating, with gentle stirring until a homogeneous solution with the network evenly dispersed in it is obtained.

Where the filamentary network is provided by a material that is soluble in the aqueous medium at its boiling point, but capable of forming the network of entangled filaments on cooling a solution at elevated temperature of the material in the remainder of the aqueous medium, the ingredients are simply mixed together, heated until a clear aqueous solution is obtained, and this is allowed to cool, when the filamentary network forms. Where the filamentary material in such an aqueous medium is the sodium salt of a $C_{14}$ to $C_{22}$ saturated fatty acid, it is not essential to start with the sodium soap; all that is necessary is for the sodium ions and fatty acid to be present so that the sodium soap can precipitate from the hot solution. Effectively all of the sodium soap appears as filamentary network: the concentration of soap remaining in solution is less than $10^{-6}$ moles per liter. Lower amounts of filament can be compensated for by higher viscosity of aqueous medium: for instance, where the soap level is relatively low, this can be compensated for by a relatively high alkyl sulphate and oxide level.

The particulate solid to be dispersed in the aqueous medium can be less dense than the aqueous medium (excluding the filamentary material), but preferably it is denser than the medium, for instance having a density of from 1.5 to 3, when the effect of the filamentary network is best observed, the difference in density between the particulate solid and aqueous medium being large, since the density of the aqueous medium will be close to 1. As inhomogeneity of the dispersion of particulate solid in the absence of the filament network can arise by the action of forces other than gravity, for instance by agglomeration due to forces of attraction between the particles, compositions of the invention also include those where the particulate solid is of the same density as the liquid in which it is dispersed.

Particulate solids suitable as abrasives are of especial interest for the preparation of pourable liquid abrasive compositions, especially detergent scourers, and the hardness of the particulate solid is preferably from 1 to 9, especially 2 to 6, on Moh's scale of hardness. Examples of suitable particulate solids are calcite, dolomite, felspar, diatomaceous earth, talc, bentonite, pumice, alumina and silica. The particulate solid can be present for some other purpose than as abrasive: for instance it can be a coloured pigment. The particulate solid is preferably of particles, at least 70% by weight of which are of diameter within the range of from 0.1 to 500 $\mu$, and especially where they are of mean diameter from 15 to 100 $\mu$.

The amount of particulate solid present in the composition will depend upon the intended function of the solid during use and the capacity of the particular filament network present to prevent the separation of the solid, which will itself depend on the filament strength and density of the network, and on the difference in density between the aqueous medium and the particulate solid. It will normally be in the range of from 0.1 to 75% by weight of the composition.

The amount of filamentary material in the composition is adjusted to give the yield stress value required according to the amount and density of the particulate material to be used in the composition. The density $d_c$ of a composition is given by $$d_c = \frac{100\, d_p}{w(1 - d_p) + 100\, d_p}$$

where $d_p$ is the density of the particulate solid and $w$ is the weight % of particulate solid in the composition. The minimum content of filamentary material in the aqueous medium required to ensure stability on long storage is given by $d_f(2d_c-1)$, where $d_f$ is the density of the filamentary material. The density of the filamentary material is in practice within the range of from 0.7 to 3 times the density of the remainder of the aqueous medium.

In preparing the composition, the particulate solid can be dispersed by stirring in the aqueous medium containing the filament network, care where necessary being taken not to break the filaments sufficiently for the network to lose its capacity for conferring a sufficient yield stress value on the aqueous medium. Alternatively the particulate solid can be added before the network is present and either dispersed at the same time as preformed filamentary material is dispersed to form the filament network, or maintained in suspension by stirring while the filament network is formed in situ. If the particulate solid is added before a filament network is formed in situ, an advantage of this procedure is that air which would normally be entrained with the solid is enabled to separate.

A liquid abrasive composition of the invention is applied in the same way as other pourable liquid scouring compositions.

Examples of compositions of the invention other than those for use as scouring compositions are pourable compositions containing solid particles of encapsulated bleaching agents, solvents, perfumes or dyes, which are released from encapsulation during use, for instance on dilution with hot water.

The invention includes the new aqueous media suitable for preparing the compositions of the invention that are described above and that contain a three-dimensional network of insoluble entangled filaments, and an alkali metal $C_{12}$ to $C_{18}$ alkyl sulphate; a trialkylamine oxide, trialkylphosphine oxide or dialkylsulphoxide detergent-active compound; and an electrolyte with a univalent or divalent cation, these ingredients being in such amounts that the aqueous medium has a viscosity at 20°C of from 1 to 60 poises at a shear rate of 7 $sec^{-1}$; especially where the aqueous medium contains an alkali metal hypochlorite.

The invention also includes a process for preparing these new aqueous media, in which the filamentary material is dispersed in the remainder of the aqueous medium and caused to form a three-dimensional network of insoluble entangled filaments. Either the preformed filaments are dispersed in the remainder of the aqueous medium, or where the filamentary material is suitable as described above, it is dissolved in the remainder of the aqueous medium at an elevated temperature and the resulting solution is cooled to form the network by filament growth in situ.

Finally, the invention includes a process for preparing a composition of the invention in which the particulate solid is dispersed in the aqueous medium before, during or after the filament network is formed.

The invention is illustrated by the following Examples, in which all amounts are by weight unless otherwise stated, and all temperatures are in °C. The aqueous sodium hypochlorite used contained 14% "available" chlorine: that is, 14 parts of chlorine were released on acidification of 100 parts with excess hydrochloric acid: the solution actually contained 14.7% sodium hypochlorite, 11.5% sodium chloride and 0.8% sodium hydroxide by weight, a total of 5 moles of univalent cation electrolyte being present per liter of solution. Viscosities (in poise) were measured using a Haake Rotovisko concentric cylinder viscometer: yield stress values (in dynes/cm²) were measured with a low shear viscometer as described by van den Tempel and LucassenReynders, J. Phys. Chem., 1963, 67, 731 using the method of Green "Industrial Rheology and Rheological Structure", (John Wiley, 1954) page 54. The densities of the aqueous media at 20° were about 1.

EXAMPLE 1

A liquid detergent bleaching and scouring composition was prepared from commercially available substances containing the following ingredients.

| | |
|---|---|
| Sodium lauryl sulphate | 1.8 |
| Sodium stearate | 1.5 |
| Dimethyllaurylamine oxide | 0.6 |
| Sodium sulphate | 0.3 |
| Sodium chloride | 1.0 |
| Aqueous sodium hypochlorite | 6.0 |
| Water | 88.8 |
| Felspar powder | 50 |

The sodium lauryl sulphate (as noodles containing the sodium sulphate and a small amount of the water), sodium stearate and amine oxide (as a solution in some of the water) were heated with the bulk of the remaining water, the temperature being raised to about 75°, until a clear solution was obtained. The remaining electrolyte as a solution in the remaining water were stirred in, and the mixture then allowed to cool to ambient temperature. Soap filament formation, which commenced at 45° as shown by the mixture becoming opaque, was then complete. The resulting gel composition became and remained pourable on gentle stirring, giving a liquid medium containing 0.88% sodium hypochlorite and 0.42 moles inorganic electrolyte per liter: it had pH 11 and viscosities at 20° of 21.0, 8.9, and 0.75 poise at shear rates of 7, 21 and 380 $sec^{-1}$, respectively. The three-dimensional network of soap filaments, as observable in a drop of the medium between glass plates under a microscope, consisted of filaments of 0.5 to 10$\mu$ diameter, many of which had a length to diameter ratio of at least 250.

The felspar powder (consisting of particles of size wholly above 0.1$\mu$ and below 100$\mu$ diameter and of mean diameter 35$\mu$ and density 2.8 and hardness 6) was gently stirred into the liquid medium to give a pourable liquid composition containing homogeneously dispersed particles, the composition having a yield stress value of 10 dynes/cm². After standing in a container for a month at ambient temperature the composition remained pourable without shaking and the particles remained substantially homogeneously dispersed with no bottom deposit and only 1 mm thickness of clear layer at the top.

EXAMPLES 2 to 61

Compositions were prepared as in Example 1, but with various ingredients. The felspar powder was as in Example 1.

The calcite powder consisted of particles of size wholly above 0.1$\mu$ and below 100$\mu$ diameter, 95% being below 53$\mu$, and mean diameter 30$\mu$; and density 2.8 and hardness 3. The dolomite powder consisted of particles of size wholly above 0.1$\mu$ and below 100$\mu$ diameter, and mean diameter 35$\mu$; and density 2.8 and hardness 3.5. The liquid media and compositions had the characteristics indicated.

In each instance a network of filaments similar to that of Example 1 was formed in the liquid medium, and the composition was pourable after allowing to stand, and was a stable dispersion. The decomposition rate of the hypochlorite where present was no greater than that of 6 parts of the same concentrated hypochlorite diluted to 100 parts with water.

| Example No. | 2 | 3 | 4 | 5 | 6 |
|---|---|---|---|---|---|
| Ingredients | | | | | |
| Sodium lauryl sulphate | 1.6 | 1.6 | 2.0 | 1.8 | 2.0 |
| Sodium stearate | 1.5 | 2.0 | 1.5 | 2.0 | 1.5 |
| Dimethyllaurylamine oxide | 0.5 | 0.7 | 0.5 | 0.7 | 0.5 |
| Aqueous sodium hypochlorite | 10.0 | 5.0 | 6.0 | | |
| Trisodium orthophosphate | | 3.0 | | 6.0 | |
| Sodium hydroxide | | 0.1 | 1.2 | 0.1 | 2.0 |
| Water | 86.4 | 87.6 | 88.8 | 89.4 | 94.0 |
| Felspar powder | 70 | 70 | 70 | 70 | 70 |
| Characteristics of Liquid Medium | | | | | |
| pH | 11.3 | 11.3 | 12.1 | 11.3 | 12.0 |
| NaOCl content % | 1.47 | 0.73 | 0.88 | 0 | 0 |
| Electrolyte (moles/liter) | 0.39 | 0.32 | 0.55 | 0.39 | 0.5 |
| Viscosity at 20° and shear rate 7 $sec^{-1}$ | 21.0 | 26.6 | 18.0 | 26.6 | 18.0 |
| Viscosity at 20° and shear rate 21 $sec^{-1}$ | 8.9 | 10.8 | 7.0 | 10.8 | 7.0 |
| Viscosity at 20° and shear rate 380 $sec^{-1}$ | 0.75 | 1.0 | 0.86 | 1.0 | 0.86 |
| Yield Stress Value of Composition | 9 | 12 | 9 | 12 | 9 |

| Example No. | 7 | 8 | 9 | 10 | 11 | 12 | 13 | 14 |
|---|---|---|---|---|---|---|---|---|
| Ingredients | | | | | | | | |
| Sodium lauryl sulphate | 2.13 | | | 0.85 | 1.28 | 1.70 | 2.13 | 2.55 |
| Sodium palmityl sulphate | | 2.27 | | | | | | |
| Sodium stearyl sulphate | | | 2.52 | | | | | |
| Sodium stearate | 1.5 | 1.5 | 1.5 | 2.0 | 1.75 | 1.5 | 1.25 | 1.0 |
| Dimethyllaurylamine oxide | 0.9 | 0.81 | 0.81 | 0.3 | 0.45 | 0.6 | 0.75 | 0.9 |
| Sodium chloride | 4.2 | 1.3 | 1.7 | 4.0 | 4.0 | 4.0 | 4.0 | 4.0 |
| Sodium hydroxide | 0.01 | 0.01 | 0.01 | 0.01 | 0.01 | 0.01 | 0.01 | 0.01 |
| Water | 91.3 | 94.1 | 93.5 | 92.8 | 92.5 | 92.2 | 91.9 | 91.5 |
| Calcite powder | 50 | 50 | 50 | 50 | 50 | 50 | 50 | 50 |
| Characteristics of Liquid Medium | | | | | | | | |
| pH | 10.8 | 10.8 | 10.8 | 10.8 | 10.8 | 10.8 | 10.8 | 10.8 |
| Electrolyte (moles/liter) | 0.72 | 0.22 | 0.29 | 0.68 | 0.68 | 0.68 | 0.68 | 0.68 |
| Viscosity at 20° and shear rate 7 $sec^{-1}$ | 20.9 | 48.8 | 53.6 | 8.97 | 14.9 | 21.9 | 23.3 | 24.3 |
| Viscosity at 20° and shear rate 21 $sec^{-1}$ | 9.3 | 23.3 | 30.3 | 3.7 | 6.1 | 8.9 | 10.1 | 10.9 |
| Viscosity at 20° and shear rate 380 $sec^{-1}$ | 0.93 | 1.89 | 2.70 | 0.44 | 0.7 | 0.82 | 0.83 | 0.81 |
| Yield Stress Value of Composition | 8 | 8 | 8 | 12 | 10 | 8 | 6 | 4 |

| Example No. | 15 | 16 | 17 | 18 | 19 | 20 | 21 | 22 | 23 |
|---|---|---|---|---|---|---|---|---|---|
| Ingredients | | | | | | | | | |
| Sodium lauryl sulphate | 1.9 | 2.2 | | | | | | | |
| Sodium palmityl sulphate | | | 1.13 | 1.72 | 2.27 | | | | |
| Sodium stearyl sulphate | | | | | | 1.23 | 1.86 | 2.45 | 2.79 |
| Sodium stearate | 1.5 | 1.5 | 1.5 | 1.5 | 1.5 | 1.5 | 1.5 | 1.5 | 1.5 |
| Dimethyllaurylamine oxide | 0.76 | 0.57 | 1.51 | 1.15 | 0.76 | 1.51 | 1.15 | 0.76 | 0.57 |
| Sodium chloride | 4.2 | 4.2 | 1.5 | 1.5 | 1.5 | 1.5 | 1.5 | 1.5 | 1.5 |
| Sodium hydroxide | 0.01 | 0.01 | 0.01 | 0.01 | 0.01 | 0.01 | 0.01 | 0.01 | 0.01 |
| Water | 91.6 | 91.5 | 94.4 | 94.1 | 94.0 | 95.2 | 95.0 | 95.8 | 93.6 |
| Dolomite powder | 50 | 50 | 50 | 50 | 50 | 50 | 50 | 50 | 50 |
| Characteristics of Liquid Medium | | | | | | | | | |
| pH | 10.8 | 10.8 | 10.8 | 10.8 | 10.8 | 10.8 | 10.8 | 10.8 | 10.8 |
| Electrolyte (moles/liter) | 0.72 | 0.72 | 0.26 | 0.26 | 0.26 | 0.26 | 0.26 | 0.26 | 0.26 |
| Viscosity at 20° and shear rate 7 $sec^{-1}$ | 22.4 | 31.1 | 19.6 | 52.1 | 46.6 | 23.7 | 28.9 | 38.1 | 33.6 |
| Viscosity at 20° and shear rate 21 $sec^{-1}$ | 9.3 | 12.7 | 7.3 | 21.7 | 18.6 | 8.2 | 12.4 | 19.4 | 21.7 |
| Viscosity at 20° and shear rate 380 $sec^{-1}$ | 0.9 | 1.07 | 1.11 | 2.06 | 1.29 | 0.81 | 1.01 | 1.72 | 1.37 |
| Yield Stress Value of Composition | 8 | 8 | 8 | 8 | 8 | 8 | 8 | 8 | 8 |

| Example No. | 24 | 25 | 26 | 27 | 28 | 29 | 30 |
|---|---|---|---|---|---|---|---|
| Ingredients | | | | | | | |
| Sodium lauryl sulphate | 1.85 | 1.85 | 1.85 | 1.85 | 1.85 | 1.85 | 1.85 |
| Sodium myristate | 1.8 | | | | 0.7 | 0.8 | |
| Sodium palmitate | | 1.7 | | | 1.2 | | 0.7 |
| Sodium stearate | | | 1.8 | | | 1.0 | 1.0 |
| Sodium behenate | | | | 1.5 | | | |
| Dimethyllaurylamine oxide | | | | 0.6 | | | |
| Sodium chloride | | | | 3.7 | | | |
| Sodium hydroxide | | | | 0.01 | | | |
| Water | 92.0 | 92.1 | 92.0 | 92.3 | 91.9 | 92.0 | 92.1 |
| Calcite powder | | | | 67 | | | |
| Characteristics of Liquid Medium | | | | | | | |
| pH | | | | 10.8 | | | |
| Electrolyte (moles/liter) | | | | 0.63 | | | |
| Viscosity at 20° and shear rate 7 $sec^{-1}$ | 43.3 | 41.9 | 39.6 | 40.5 | 41.8 | 51.3 | 30.3 |
| Viscosity at 20° and shear rate 21 $sec^{-1}$ | 17.0 | 14.8 | 13.9 | 17.9 | 16.3 | 18.6 | 11.8 |
| Viscosity at 20° and shear rate 380 $sec^{-1}$ | 1.33 | 1.2 | 1.16 | 1.12 | 1.42 | 1.84 | 1.03 |
| Yield Stress Value of Composition | 10 | 10 | 10 | 10 | 10 | 14 | 10 |

| Example No. | 31 | 32 | 33 | 34 | 35 | 36 | 37 | 38 | 39 | 40 | 41 |
|---|---|---|---|---|---|---|---|---|---|---|---|
| Ingredients | | | | | | | | | | | |
| Sodium lauryl sulphate | 1.3 | 1.3 | 1.3 | 1.3 | 1.5 | 1.9 | 2.4 | 1.7 | 1.7 | 1.7 | 1.7 |
| Sodium stearate | 1.2 | 1.5 | 1.9 | 2.2 | 1.7 | 1.5 | 1.36 | 1.8 | 1.6 | 1.3 | 1.0 |
| Dimethyllaurylamine oxide | 0.45 | 0.45 | 0.45 | 0.45 | 0.61 | 0.8 | 1.0 | 0.75 | 0.75 | 0.75 | 0.75 |
| Sodium chloride | | | | | | 3.7 | | | | | |
| Sodium hydroxide | | | | | | 0.01 | | | | | |
| Water | 93.3 | 93.0 | 92.6 | 92.3 | 92.5 | 92.1 | 91.5 | 92.0 | 92.3 | 92.5 | 92.8 |
| Particulate solid of diameter within the range 0.1 to 100μ, mean diameter 40μ, and density 2.8 | 8.7 | 28 | 43 | 61 | 43 | 43 | 43 | 43 | | | |
| 2.1 | | | | | | | | | 43 | | |
| 1.5 | | | | | | | | | | 43 | |
| 1.1 | | | | | | | | | | | 43 |
| Characteristics of Liquid Medium | | | | | | | | | | | |
| pH | | | | | | 10.8 | | | | | |
| Electrolyte (moles/liter) | | | | | | 0.63 | | | | | |
| Viscosity at 20° and shear rate: 7 sec⁻¹ | 18.1 | 18.6 | 19.1 | 21.0 | 25.1 | 29.2 | 32.6 | 31.7 | 24.7 | 23.7 | 21.0 |
| 21 sec⁻¹ | 7.0 | 7.5 | 7.8 | 8.7 | 10.3 | 11.7 | 12.9 | 12.3 | 10.1 | 9.6 | 8.1 |
| 380 sec⁻¹ | 0.59 | 0.69 | 0.73 | 0.83 | 0.88 | 0.90 | 0.99 | 1.03 | 0.82 | 0.77 | 0.67 |
| Yield Stress Value of Composition | 5 | 7 | 10 | 15 | 8 | 6 | 5 | 11 | 9 | 5 | 3 |

| Example No. | 42 | 43 | 44 | 45 | 46 | 47 | 48 | 49 | 50 | 51 |
|---|---|---|---|---|---|---|---|---|---|---|
| Ingredients | | | | | | | | | | |
| Sodium lauryl sulphate | 1.3 | | | 1.32 | 1.53 | 1.02 | 0.85 | 1.42 | | 3.8 |
| Sodium palmityl sulphate | | 1.72 | | | | | | | | |
| Sodium stearyl sulphate | | | 1.9 | | | | | | 1.2 | |
| Sodium stearate | 1.5 | 1.5 | 1.5 | 1.7 | 1.7 | 1.7 | 1.7 | 1.5 | 1.5 | 1.5 |
| Dimethyllaurylamine oxide | 0.45 | 1.2 | 1.2 | | | | | | | |
| Dimethylmyristylamine oxide | | | | 0.48 | 0.81 | | | | | |
| Mixture of dimethyl-palmityl- and -stearyl-amine oxides | | | | | | 0.2 | 0.3 | | | |
| Dimethyllauryl phosphine oxide | | | | | | | | 1.22 | 1.62 | |
| Methyllauryl sulphoxide | | | | | | | | | | 1.2 |
| Sodium chloride | 4.0 | 1.3 | 2.0 | 2.2 | 1.1 | 3.9 | 1.7 | 0.9 | 0.34 | 1.5 |
| Sodium hydroxide | 0.01 | 0.01 | 0.01 | 0.01 | 0.01 | 0.01 | 0.01 | 0.01 | 0.01 | 0.01 |
| Water | 93.7 | 94.3 | 93.4 | 95.3 | 94.8 | 93.2 | 95.4 | 94.9 | 95.3 | 92.0 |
| Calcite powder | 50 | 50 | 50 | | | | | 50 | 50 | 50 |
| Dolomite powder | | | | 50 | 50 | 50 | 50 | | | |
| Characteristics of Liquid Medium | | | | | | | | | | |
| pH | 10.8 | 10.8 | 10.8 | 10.8 | 10.8 | 10.8 | 10.8 | 10.8 | 10.8 | 10.8 |
| Electrolyte (moles/liter) | 0.68 | 0.22 | 0.34 | 0.38 | 0.19 | 0.67 | 0.29 | 0.15 | 0.06 | 0.26 |
| Viscosity at 20° and shear rates of: 7 sec⁻¹ | 16.7 | 48.9 | 20.0 | 14.9 | 20 | 16.3 | 15.6 | 23.6 | 25.7 | 14.4 |
| 21 sec⁻¹ | 7.0 | 17.4 | 8.4 | 5.6 | 17.0 | 6.66 | 5.6 | 9.0 | 9.3 | 9.3 |
| 380 sec⁻¹ | 0.69 | 1.54 | 0.86 | 0.46 | 1.54 | 0.62 | 0.47 | 0.84 | 0.91 | 1.07 |
| Yield Stress Value of Composition | 8 | 8 | 8 | 9 | 9 | 9 | 9 | 8 | 8 | 8 |

| Example No. | 52 | 53 | 54 | 55 | 56 | 57 | 58 | 59 |
|---|---|---|---|---|---|---|---|---|
| Ingredients | | | | | | | | |
| Sodium lauryl sulphate | 1.28 | 1.28 | 1.28 | 1.28 | 1.28 | 1.28 | 1.28 | 1.28 |
| Sodium stearate | 1.4 | 1.9 | 1.9 | 1.9 | 1.4 | 1.9 | 1.9 | 1.9 |
| Dimethyllaurylamine oxide | 0.45 | 0.45 | 0.45 | 0.45 | 0.45 | 0.45 | 0.45 | 0.45 |
| Trisodium orthophosphate | 9.0 | | | | | | | |
| Sodium sulphate | | 8.5 | | | | | | |
| Sodium chloride | | | 4.0 | | | | | |
| Sodium carbonate | | | | 6.4 | | | | |
| Sodium tripolyphosphate | | | | | 15 | | | |
| Sodium chlorate | | | | | | 6.4 | | |
| Ammonium sulphate | | | | | | | 6.8 | |
| Calcium chloride | | | | | | | | 0.3 |
| Sodium hydroxide | 0.01 | 0.01 | 0.01 | 0.01 | 0.01 | 0.01 | 0.01 | 0.01 |
| Water | 86.9 | 87.9 | 92.4 | 90.0 | 83.1 | 91.2 | 90.8 | 96.1 |
| Calcite powder | 50 | 50 | 50 | 50 | 50 | 50 | 50 | 50 |
| Characteristics of Liquid Medium | | | | | | | | |
| pH | 10.6 | 10.6 | 10.6 | 10.6 | 10.6 | 10.6 | 10.6 | 10.6 |
| Electrolyte (moles/liter) | 0.55 | 0.60 | 0.68 | 0.60 | 0.41 | 0.60 | 0.52 | 0.027 |
| Viscosity at 20° and shear rates of: 7 sec⁻¹ | 48 | 20 | 20 | 20 | 48 | 20 | 20 | 16 |
| 21 sec⁻¹ | 18 | 8 | 8 | 8 | 18 | 8 | 8 | 7 |
| 380 sec⁻¹ | 1.4 | 0.7 | 0.7 | 0.7 | 1.4 | 0.7 | 0.7 | 0.7 |
| Yield Stress Value of Composition | 11 | 11 | 11 | 11 | 11 | 11 | 11 | 11 |

| Example No. | 60 | 61 |
|---|---|---|
| Ingredients | | |
| Sodium lauryl sulphate | 3.1 | 4.17 |
| Sodium stearate | 1.7 | 1.7 |
| Dimethyllaurylamine oxide | 0.70 | 0.33 |
| Sodium hypochlorite solution | 11 | 11 |
| Sodium chloride | 1.0 | 1.0 |
| Beta-ionone | 0.22 | |
| Nonyl acetate | | 0.22 |
| Water | 82.3 | 81.6 |
| Calcite powder | 50 | 50 |
| Characteristics of Liquid Medium | | |
| pH | 10.9 | 10.9 |
| Electrolyte (moles/liter) | 0.53 | 0.53 |
| Viscosity at 20° and shear rate: 7 sec⁻¹ | 34.4 | 41.4 |
| 21 sec⁻¹ | 16.0 | 15.5 |
| 380 sec⁻¹ | 0.99 | 1.16 |
| Yield Stress Value of Composition | 8 | 8 |

The final products were pourable, stable, and had a network of filaments similar to that of Example 1.

In the above Examples 1 to 61 the filament network is provided by a soap. The appearance of a typical soap filament network is illustrated in the accompanying FIGS. 1 to 4, which are phase contrast photomicrographs taken of drops of aqueous medium.

Figure 2:
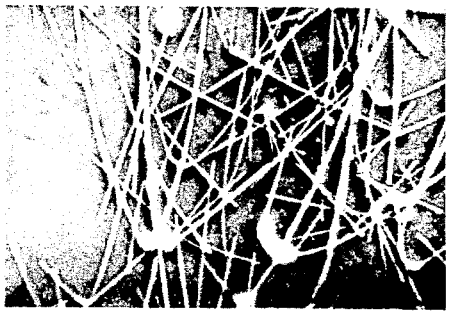
Figure 3:
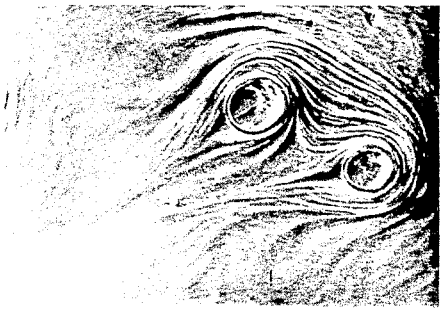
Figure 4:
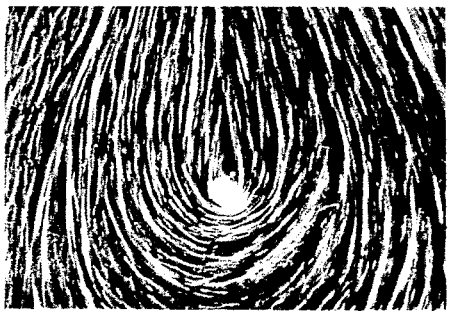

FIG. 1 shows at magnification × 90 the entangled network of soap filaments densely pervading the liquid. FIG. 2 shows at magnification × 225 a portion of the same aqueous medium isolated as a very thin film at an interface with an air bubble. The soap filaments, which exhibit abrupt curvature and possible interlocking, have diameters of from 0.5 to 10μ, and a typical diameter of 2.5μ, with filament length commonly at least 100 × diameter. FIG. 3 shows at magnification × 22 the same aqueous medium with two air bubbles of diameter about 500μ entrapped by the network of soap filaments. FIG. 4 shows at magnification × 90 the same aqueous medium full of entangled soap filaments with a solid particle of diameter 25μ interacting with them and deforming the network.

EXAMPLE 62

Compositions were prepared from the following ingredients.

| | |
|---|---|
| Sodium lauryl sulphate | 1.73 |
| Dimethyllaurylamine oxide | 0.6 |
| Sodium chloride | 4.0 |
| Sodium hydroxide | 0.01 |
| Long-fibre asbestos (density 2.5) | 2.0 |
| Water | 91.7 |
| Calcite powder | 11 |

To the asbestos fibre was added the water and the mixture was mechanically pulped in a colloid mill: the remaining ingredients were added to the resulting slurry and the mixture heated to dissolve them, with stirring, and then cooled. The aqueous medium thus obtained, of pH 10.6 and electrolyte concentration 0.68 moles per liter, had viscosities at 20° and 7, 21 and 380 $sec^{-1}$ of 31.7, 12.4 and 1.08 respectively.

Figure 5:
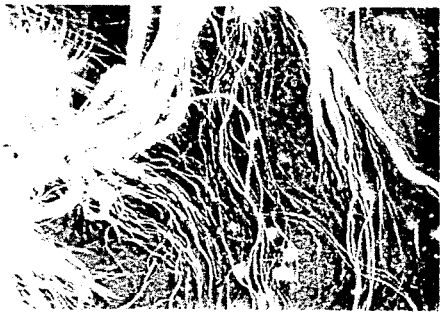

On viewing a drop of the aqueous medium between glass slides at magnification × 40, a network of entangled filaments was seen, some filaments having relatively thick main stems with hair-like branching, while others were relatively thin, with filament diameters in a wide range from 0.5 to 100μ, and of length at least 100 × diameter. The appearance of the filaments at × 90 is illustrated by the phrase contrast photomicrograph which is the accompanying FIG. 5.

The calcite was dispersed in the aqueous medium with gentle stirring to give a pourable composition of yield stress value 15 which was stable for at least a week. When the asbestos was absent in a similar composition, there was no yield value and deposition of the calcite and the formation of a clear supernatant were apparent within 1 hour.

EXAMPLE 63

A composition was prepared as in Example 62, except that instead of asbestos fibre, cellulose fibre of density 1.5 provided by shredded newsprint was used. The medium had substantially the same viscosities as that of Example 62, and the yield stress value of the composition was 15.

Figure 6:
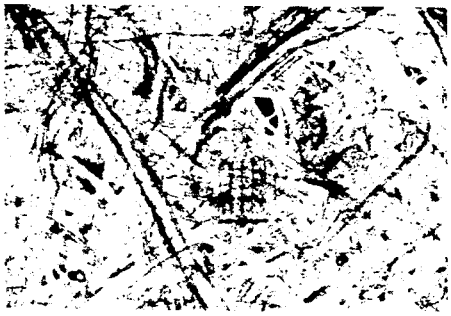

The accompanying FIG. 6, which is a phase contrast photomicrograph taken of a drop of the liquid medium between glass slides, illustrates the appearance of the resulting filamentary network at magnification × 90. The entangled cellulose filaments have a jointed appearance and are of a range of diameters from 5 to 100μ, and of length at least 100 × diameter.

What is claimed is:

1. A pourable liquid composition having a yield stress value at 20°C of from 1 to 21 dynes/cm², comprising an aqueous medium having a viscosity at 20°C of from 1 to 60 poise at a shear rate of 7 $sec^{-1}$, containing a three-dimensional network of insoluble entangled filaments having a diameter of from 0.1 to 100μ and a length to diameter ratio of at least 60, and particulate solid dispersed in the medium and prevented from separating from the medium by the filament network.

2. A composition according to claim 1, and having a yield stress value of from 4 to 15 dynes/cm².

3. A composition according to claim 1, in which the aqueous medium has viscosities at 20°C of from 1 to 30 and from 0.1 to 3.0 poise at shear rates of 21 $sec^{-1}$ and 380 $sec^{-1}$, respectively, the ratio of viscosities at these shear rates being from 4 to 18:1.

4. A composition according to claim 3, where the viscosity at a shear rate of 21 $sec^{-1}$ is from 5 to 20 and the ratio of viscosities at shear rates of 21 $sec^{-1}$ and 380 $sec^{-}$is from 10 to 17:1.

5. A composition according to claim 1, in which the liquid medium contains a detergent-active compound in solution.

6. A composition according to claim 5, in which the detergentactive compound is an alkali metal $C_{12}$ to $C_{18}$ alkyl sulphate.

7. A composition according to claim 6, in which the aqueous medium contains a trialkylamine oxide, trialkylphosphine oxide or dialkylsulphoxide detergent-active compound, and an electrolyte with a univalent or divalent cation, in such amounts that the aqueous medium has a viscosity at 20°C of from 1 to 60 poises at a shear rate of 7 $sec^{-1}$.

8. A composition according to claim 7, containing a trialkylamine oxide $R_3NO$ where one group R is a $C_{10}$ to $C_{18}$ n-alkyl group and the other groups R are each methyl or ethyl.

9. A composition according to claim 7, containing a trialkylphosphine oxide $R_3PO$ where one group R is a $C_{10}$ to $C_{18}$ n-alkyl group and the other groups R are each methyl or ethyl.

10. A composition according to claim 7, containing a dialkylsulphoxide $R_2SO$ where one group R is a $C_{10}$ to $C_{18}$ n-alkyl group and the other is methyl or ethyl.

11. A composition according to claim 7, where the aqueous medium contains from 0.02 to 5% by weight of an alkali metal hypochlorite.

12. A composition according to claim 1, where the material of the filaments is soluble in the aqueous medium at its boiling point, but capable of forming the network of entangled filaments on cooling a solution at elevated temperature of the material in the remainder of the aqueous medium.

13. A composition according to claim 12, in which the filaments are of soap.

14. A composition according to claim 13, in which the soap is a sodium salt of a saturated $C_{14}$ to $C_{22}$ fatty acid.

15. A composition according to claim 7, in which the filaments are of a sodium salt of a saturated $C_{14}$ to $C_{22}$ fatty acid.

16. A composition according to claim 1, where the particulate solid is of particles at least 70% by weight of which are of diameter within the range of from 0.1 to 500μ, and the means diameter of the particles is from 15 to 100μ.

17. A composition according to claim 1, where the particulate material is of density from 1.5 to 3.

18. A process for preparing a composition according to claim 12, comprising dissolving the filamentary material in the remainder of the liquid medium at an elevated temperature, cooling the resulting solution to form the network by filament growth in situ; and dispersing the particulate solid in the aqueous medium before, during or after formation of the filament network.

19. An aqueous medium comprising (*a*) an alkali metal $C_{12}$ to $C_{18}$ alkyl sulphate, (*b*) a trialkylamine oxide, trialkylphosphine oxide or dialkylsulphoxide detergent-active compound, (*c*) an electrolyte with a univalent or divalent cation, and (*d*) a three-dimensional network of insoluble entangled filaments having a diameter of from 0.1 to 100$\mu$ and a length to diameter ratio of at least 60; in such amounts that the medium has a viscosity at 20°C of from 1 to 60 poise at a shear rate of 7 $sec^{-1}$ and a yield stress value at 20°C of from 1 to 21 dynes/$cm^2$.

20. A medium according to claim 19, in which the filaments are of a sodium salt of a saturated $C_{14}$ to $C_{22}$ fatty acid.

* * * * *